US009459065B2

(12) United States Patent
Palu

(10) Patent No.: US 9,459,065 B2
(45) **Date of Patent: *Oct. 4, 2016**

(54) FLASH SUPPRESSOR FOR FIREARM

(71) Applicant: Thunder Beast Arms Corporation, Cheyenne, WY (US)

(72) Inventor: Kurtis A. Palu, Wellington, CO (US)

(73) Assignee: Thunder Beast Arms Corporation, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/987,984

(22) Filed: Jan. 5, 2016

(65) Prior Publication Data

US 2016/0146561 A1 May 26, 2016

Related U.S. Application Data

(62) Division of application No. 14/465,060, filed on Aug. 21, 2014, now Pat. No. 9,261,319.

(51) Int. Cl.
*F41A 21/34* (2006.01)
*F41A 21/36* (2006.01)

(52) U.S. Cl.
CPC ..... *F41A 21/34* (2013.01); *F41A 21/36* (2013.01)

(58) Field of Classification Search
CPC ..... F41A 21/32; F41A 21/325; F41A 21/34; F41A 21/36; F41A 21/30
USPC ..... D22/108; 89/14.2, 14.3, 14.4; 181/223; 42/1.06, 76.01, 107
See application file for complete search history.

(56) References Cited

U.S. PATENT DOCUMENTS

| | | | | |
|---|---|---|---|---|
| 2,900,875 | A * | 8/1959 | Fergus | F41A 21/30 181/223 |
| 5,433,133 | A | 7/1995 | La France | |
| 5,476,028 | A | 12/1995 | Seberger | |
| 5,596,161 | A * | 1/1997 | Sommers | F41A 21/34 89/14.2 |
| 6,948,415 | B2 | 9/2005 | Matthews et al. | |
| 6,973,863 | B1 | 12/2005 | Jones | |
| 7,062,874 | B1 | 6/2006 | Smith | |
| D577,409 | S | 9/2008 | Brittingham | |
| D577,410 | S * | 9/2008 | Brittingham | D22/108 |
| 7,610,710 | B2 | 11/2009 | Brittingham | |
| D610,221 | S * | 2/2010 | Brittingham | D22/108 |
| 7,661,349 | B1 | 2/2010 | Brittingham | |
| 7,743,693 | B1 | 6/2010 | Brittingham | |
| 7,789,009 | B1 | 9/2010 | Brittingham | |
| 7,861,636 | B1 * | 1/2011 | Hoffman | F41A 21/34 89/14.2 |
| 7,874,238 | B2 | 1/2011 | Silvers | |
| 7,905,170 | B1 * | 3/2011 | Brittingham | F41A 21/325 89/14.2 |
| 7,926,404 | B2 | 4/2011 | Brittingham | |
| 7,954,414 | B2 | 6/2011 | Dueck et al. | |

(Continued)

FOREIGN PATENT DOCUMENTS

WO WO 97/07375 A2 2/1997

OTHER PUBLICATIONS

U.S. Appl. No. 14/465,060; Notice of Allowance dated Nov. 6, 2015; 20 pages.

*Primary Examiner* — John D Cooper
(74) *Attorney, Agent, or Firm* — Swanson & Bratschun, L.L.C.

(57) ABSTRACT

Novel flash suppressors comprised of tines formed by cuts of varied lengths and widths to better reduce muzzle flash and eliminate any unwanted ringing caused by resonance of the tines.

9 Claims, 7 Drawing Sheets

(56) References Cited

U.S. PATENT DOCUMENTS

| | | | | |
|---|---|---|---|---|
| D646,345 | S | 10/2011 | Oliver | |
| 8,091,462 | B2 | 1/2012 | Dueck et al. | |
| 8,196,701 | B1 | 6/2012 | Oliver | |
| 8,201,487 | B2 | 6/2012 | Dueck et al. | |
| 8,205,538 | B2 | 6/2012 | Dueck et al. | |
| 8,209,895 | B2 | 7/2012 | Dueck et al. | |
| 8,286,750 | B1 | 10/2012 | Oliver | |
| 8,397,862 | B2 | 3/2013 | Shand | |
| D687,119 | S | 7/2013 | Dueck | |
| 8,490,534 | B1 * | 7/2013 | Moore | F41A 21/34 181/223 |
| 8,490,535 | B1 | 7/2013 | Moore et al. | |
| 8,499,676 | B1 | 8/2013 | Moore et al. | |
| 8,505,680 | B2 | 8/2013 | Dueck | |
| 8,516,941 | B1 | 8/2013 | Oliver | |
| 8,539,708 | B2 | 9/2013 | Kenney et al. | |
| 8,555,765 | B2 | 10/2013 | Graham et al. | |
| D693,896 | S | 11/2013 | Dueck | |
| 8,584,794 | B2 | 11/2013 | Dueck | |
| 8,714,301 | B2 * | 5/2014 | Shults | F41A 21/30 181/223 |
| 8,763,510 | B2 | 7/2014 | Dueck et al. | |
| 8,794,376 | B2 | 8/2014 | Shults et al. | |
| 8,826,793 | B2 | 9/2014 | Oliver | |
| 9,261,319 | B1 | 2/2016 | Palu | |
| 2004/0123729 | A1 * | 7/2004 | Meyers | F41A 21/34 89/14.2 |
| 2014/0137452 | A1 * | 5/2014 | Coleman | F41A 21/36 42/1.06 |
| 2015/0260472 | A1 * | 9/2015 | Smith | F41A 21/30 89/14.2 |
| 2016/0054087 | A1 | 2/2016 | Palu | |

* cited by examiner

FLASH SUPPRESSOR FOR FIREARM

RELATED APPLICATIONS

This application is a divisional of U.S. patent application Ser. No. 14/465,060, filed Aug. 21, 2014 by Kurtis A. Palu and titled, "Flash Suppressor for Firearm", which is incorporated herein by reference in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a flash suppressor for a firearm, and more particularly, to a flash suppressor that includes a plurality of tines formed in a way to better reduce muzzle flash and eliminate any unwanted ringing caused by resonance of the tines.

BACKGROUND

In order to fire a projectile, a firearm utilizes an ignited propellant to create a high-pressure pulse of hot gases behind the projectile to force the projectile down the barrel of the firearm. When a projectile is fired from most firearms, a visible signature or flash, commonly referred to as "muzzle flash," exits the barrel of the firearm after the discharge of the projectile. Muzzle flash has a number of undesirable effects, including temporarily impairing the vision of the person using the firearm, particularly in cases where the person is using the firearm in limited light conditions. Muzzle flash is caused by a number of factors, including propellant gases exiting the barrel of the firearm after the projectile and the mixture of such gases with the ambient air. The severity of muzzle flash depends on number of factors, including the type of firearm and ammunition being used. Muzzle flash is often more severe in firearms with shorter barrels because there is less distance for the propellant to be consumed before exiting the barrel.

Muzzle flash can be reduced through the use of a flash hider, which attaches to end of the firearm barrel and mechanically disperses the gases exiting the firearm in a way to reduce the visible flash. Flash hiders come is variety of designs, including the use of a plurality of prongs, or tines, extending from the end of the barrel of firearm. However, when flash hiders use tines to reduce muzzle flash, the high-pressure gases exiting the firearm can cause the tines to resonate and cause an undesirable ringing sound. In addition, tines used in certain flash hiders may be relatively long and vary in length. Tines that vary in length can create a number of difficulties, including, for example, making it difficult to attach other firearm components such as a noise suppressor to the flash suppressor. Having tines of different length also can result in the longer tine catching on debris and other impediments during field use and absorbing the majority of the impact if the firearm receives an impact at its distal end, such as being dropped on its barrel.

Accordingly, there is a need for a flash suppressor that effectively suppresses muzzle flash without creating any ringing or other undesirable sound effects, but which can also be effectively used in a field environment and designed so that other firearm components can be easily attached to it.

BRIEF SUMMARY

Certain embodiments include flash suppressors for firearms that effectively suppress muzzle flash using a plurality of tines of equal mass oriented in a helical manner. In certain embodiments, each tine extends to the same plane perpendicular to the distal end of the flash suppressor and the cuts used to form the tines vary in length and/or width in order to prevent an audible ringing or other undesirable effects. In addition, in certain embodiments, each tine contains a groove in its outer surface where each groove can be varied in length, width and/or depth in order to reduce the weight of the tine and to achieve other desired effects. In aspects of certain embodiments, a circular face of the flash hider located adjacent to the muzzle contains a bore that has the same circumference as the bore formed by the internal surfaces of the tines.

The embodiments of the invention described herein are defined by the claims. Further advantages and a more complete understanding of the embodiments will be apparent to persons skilled in the art from review following detailed description of various embodiments and appended claims.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present inventions may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
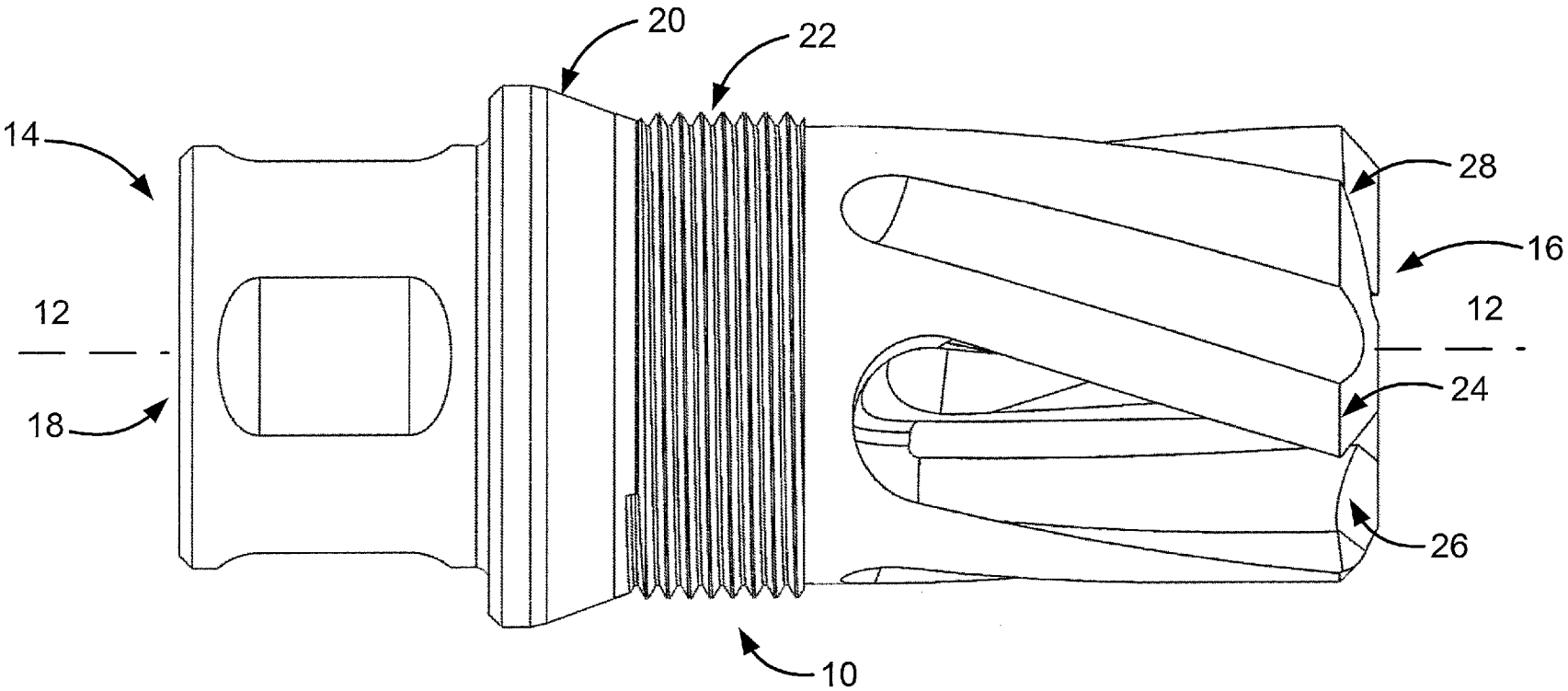
FIG. 1 shows a side view of an embodiment of the present invention.
Figure 2:
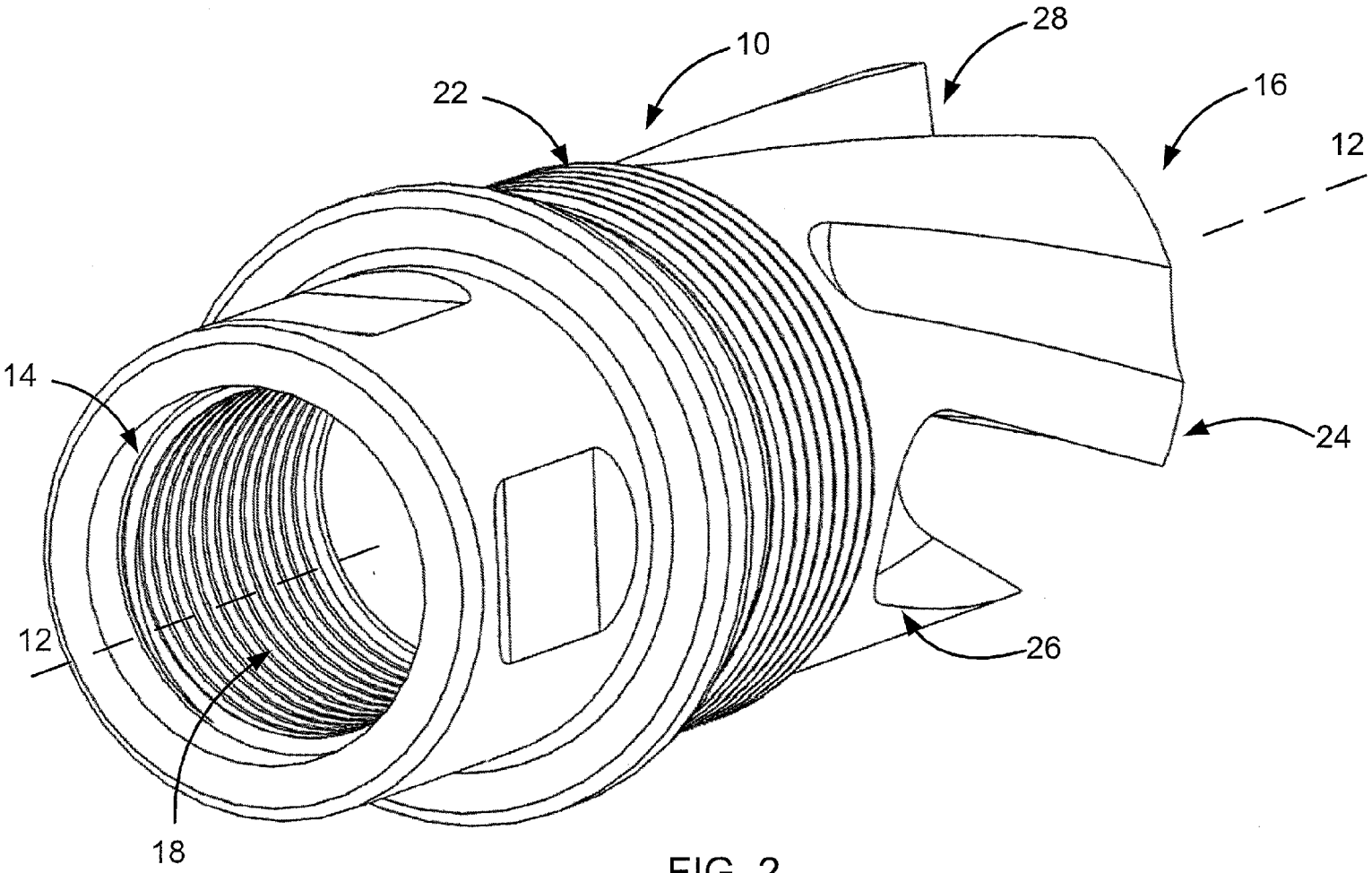
FIG. 2 shows a perspective end view of the proximal end of the flash suppressor of FIG. 1.

FIG. 1 is a side view of an exemplary flash suppressor 10 in accordance with an embodiment of the present invention. FIG. 2 is a perspective end view from the proximal end of flash suppressor 10 in accordance with an embodiment of the present invention. As shown, flash suppressor 10 includes a central axis 12, a proximal end 14, and a distal end 16. As used in this detailed description, the term "proximal" is used to refer to the end of the component or element closest to the barrel of the firearm and the term "distal" is used to refer to the end of the component or element farthest from the barrel of the firearm. Proximal end 14 of flash suppressor 10 includes a threaded interface 18, which is used to connect flash suppressor 10 to the muzzle of a firearm that is not shown in FIGS. 1 and 2. Flash suppressor 10 includes an angular shoulder 20 and threaded interface 22, which can be used to help connect flash suppressor 10 to another firearm attachment such as a noise suppressor. Flash suppressor 10 also includes three tines 24, 26, and 28. When a projectile is fired from a firearm attached to flash suppressor 10, the gases proceed through the barrel of the firearm into flash suppressor 10 and are dispersed by tines 24, 26, and 28 as explained in more detail below.

Figure 3:
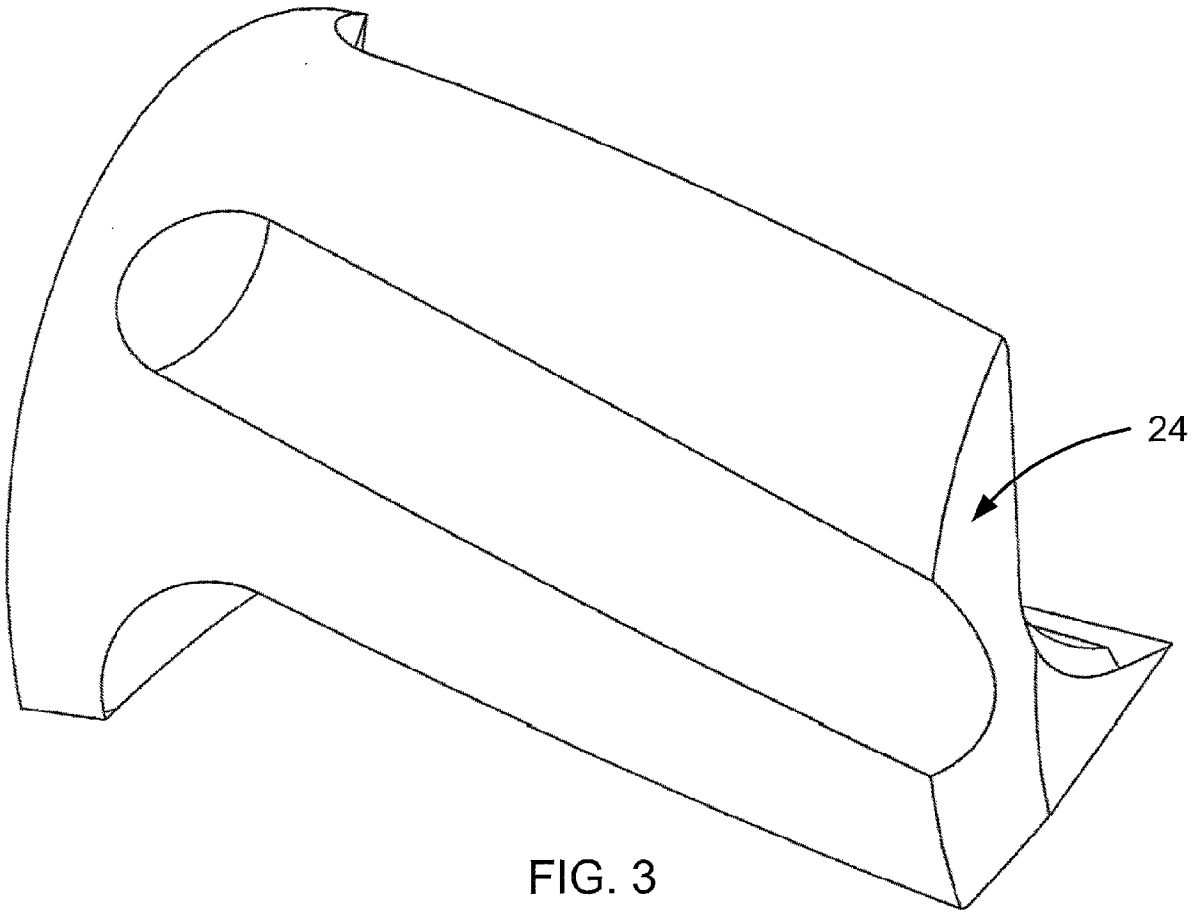
FIG. 3 is a perspective view of an individual tine of the flash suppressor of FIG. 1.
Figure 4:
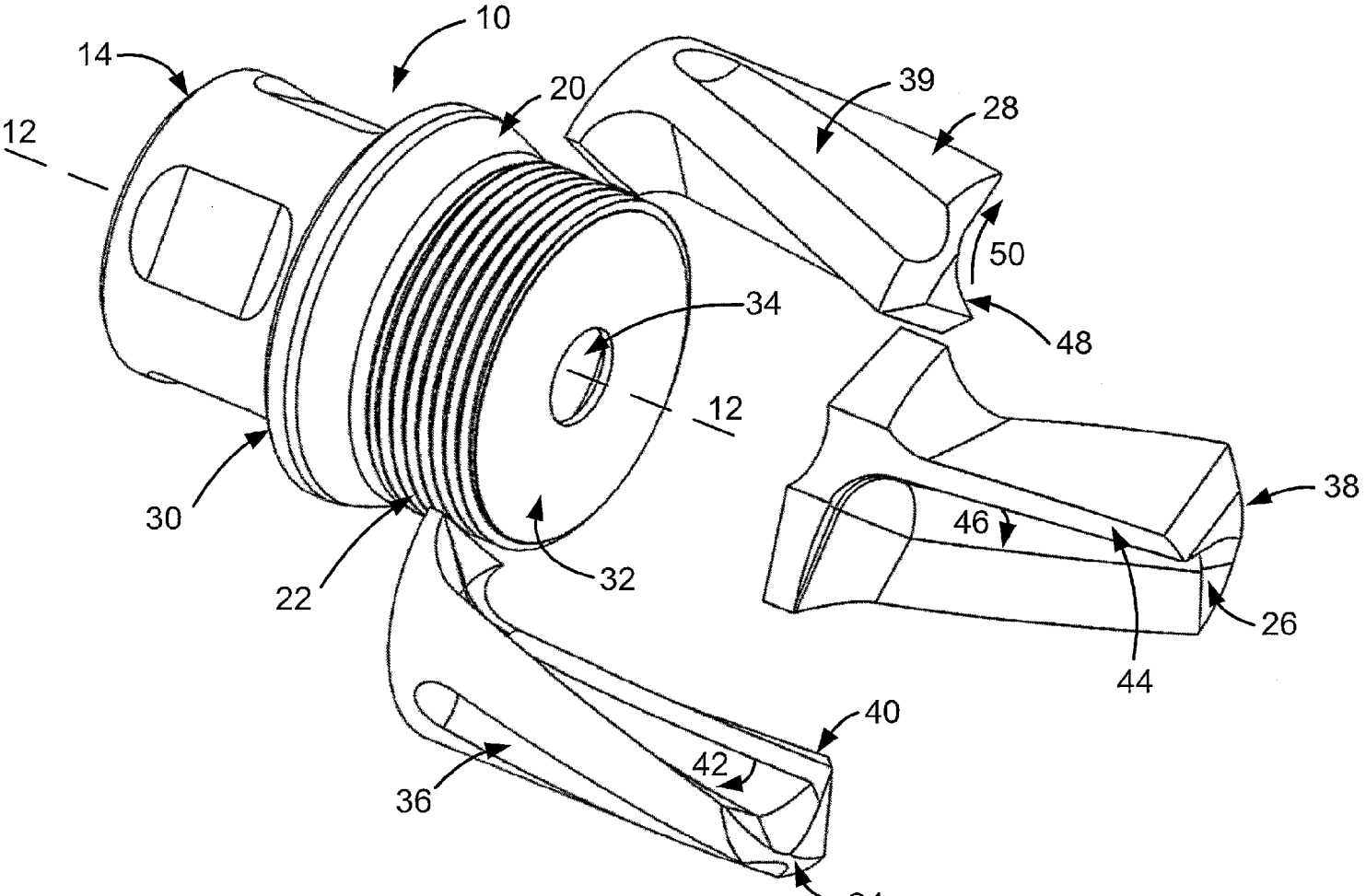
FIG. 4 is an exploded perspective view of the flash suppressor of FIG. 1.

FIG. 3 is a perspective view of individual tine 24 of the flash suppressor of FIG. 1. FIG. 4 is an exploded perspective view of the flash suppressor of FIG. 1. As shown in FIG. 3, tine 24 is formed in a helical shape. In this embodiment, tine 24 is formed using a helical cut that can be measured in such a way whereby if tine 24 were extended 8.8 inches it would form a complete rotation around a tube with a 0.9 inch diameter. In this particular embodiment, the helical cut of each tine is oriented in clockwise, or right-handed twist, when viewed from the direction of the projectile path through flash suppressor 10. This is the same orientation of the rifling in most firearms.

FIG. 4 further shows the embodiment of the flash suppressor of FIG. 1. Flash suppressor 10 has a base 30, which consists of the portion of flash suppressor 10 from the distal end 14 through the proximal end of angular shoulder 20. Base 30 has a circular face 32 that contains bore 34. When a firearm is attached to flash suppressor 10, the muzzle of the firearm (not shown) attaches to threaded interface 18 as shown in FIG. 2. The bore of the barrel of the firearm aligns with bore 34. In this embodiment, the diameter of bore 34 is the approximate size of the diameter of the bore in the barrel of the firearm. As also shown in FIG. 4, tine 24 contains groove 36, tine 26 contains groove 38, and tine 28 contains groove 39 wherein each groove is formed by making a cut of a certain width and depth from the distal end of the suppressor. Each groove reduces the weight of each tine, which improves the overall performance of flash suppressor 10.

As the gases created from the firing of a projectile exit the barrel, these expelled gases proceed through bore 34 and are dispersed by tines 24, 26, and 28 shown in FIG. 4. Each tine has an inner surface that receives the expelled gases through bore 34 and disperses the gases into the ambient air to dramatically reduce, if not completely eliminate, muzzle flash by rapidly cooling and diluting the propellant gases as they exit the firearm barrel. More specifically, tine 24 contains inner surface 40 and directs expelled gases in the direction shown by arrow 42, which allows a portion of the expelled gases to be dispersed and mixed with ambient air through the cut between tine 24 and tine 28. Similarly, tine 26 contains inner surface 44 and directs expelled gases in the direction shown by arrow 46, which allows a portion of the expelled gases to be dispersed and mixed with ambient air through the cut between tine 24 and tine 26. Finally, tine 28 also contains an inner surface, which is not directly shown but indicated by arrow 48. Inner face 48 of tine 28 directs expelled gases in the direction shown by arrow 50, which allows a portion of the expelled gases to be dispersed and mixed with ambient air through the cut between tine 26 and tine 28.

Figure 5:
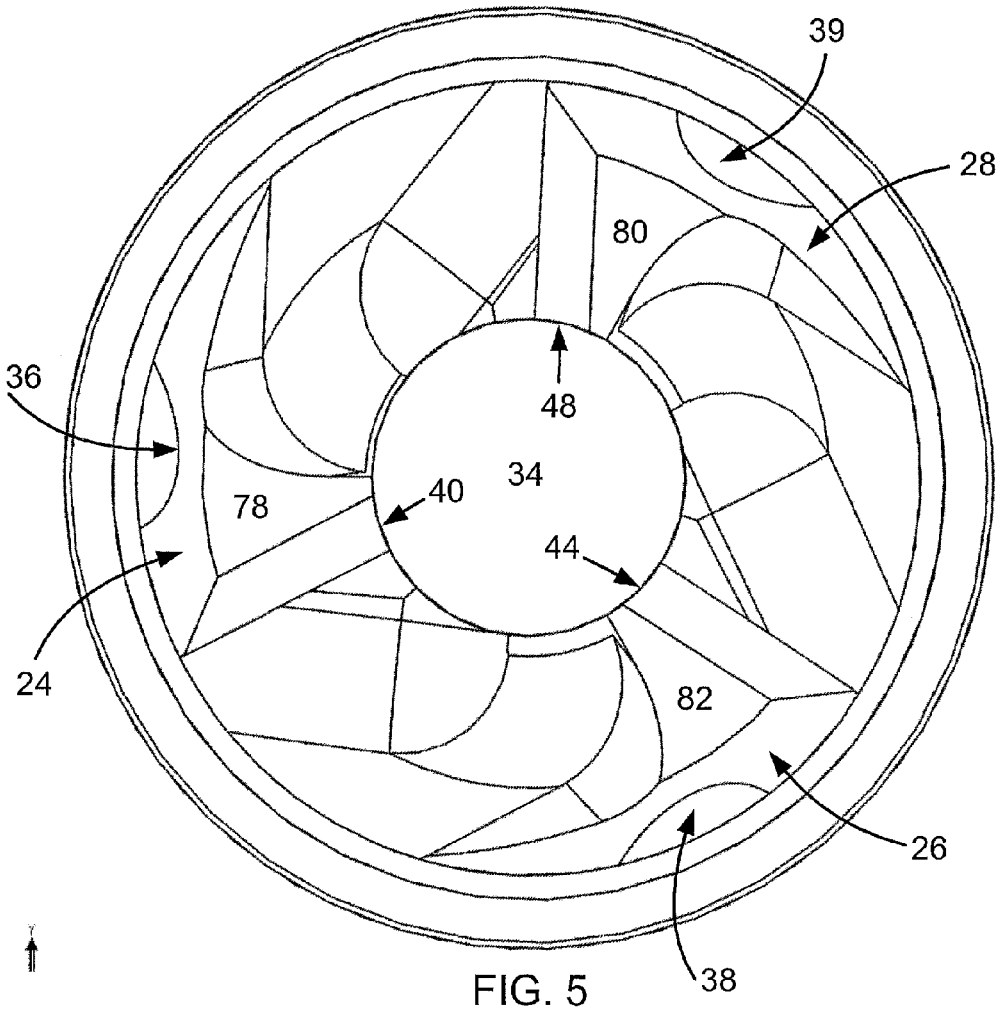
FIG. 5 is a view of the distal end of the flash suppressor of FIG. 1.

FIG. 5 depicts the distal end view of flash suppressor 10 and, in this particular embodiment, inner surfaces 40, 44, and 48 of tines 24, 26, and 28, respectively, form a bore that has substantially the same diameter as bore 34. This particular spacing of tines 24, 26, and 28 helps to ensure that the expelled gases are dispersed radially from the suppressor through the cuts between the tines. This increases the rate in which the expelled gases are mixed with the ambient air and reduces the chances of the gases igniting unused propellant before they are expelled from flash suppressor 10.

Figure 6:
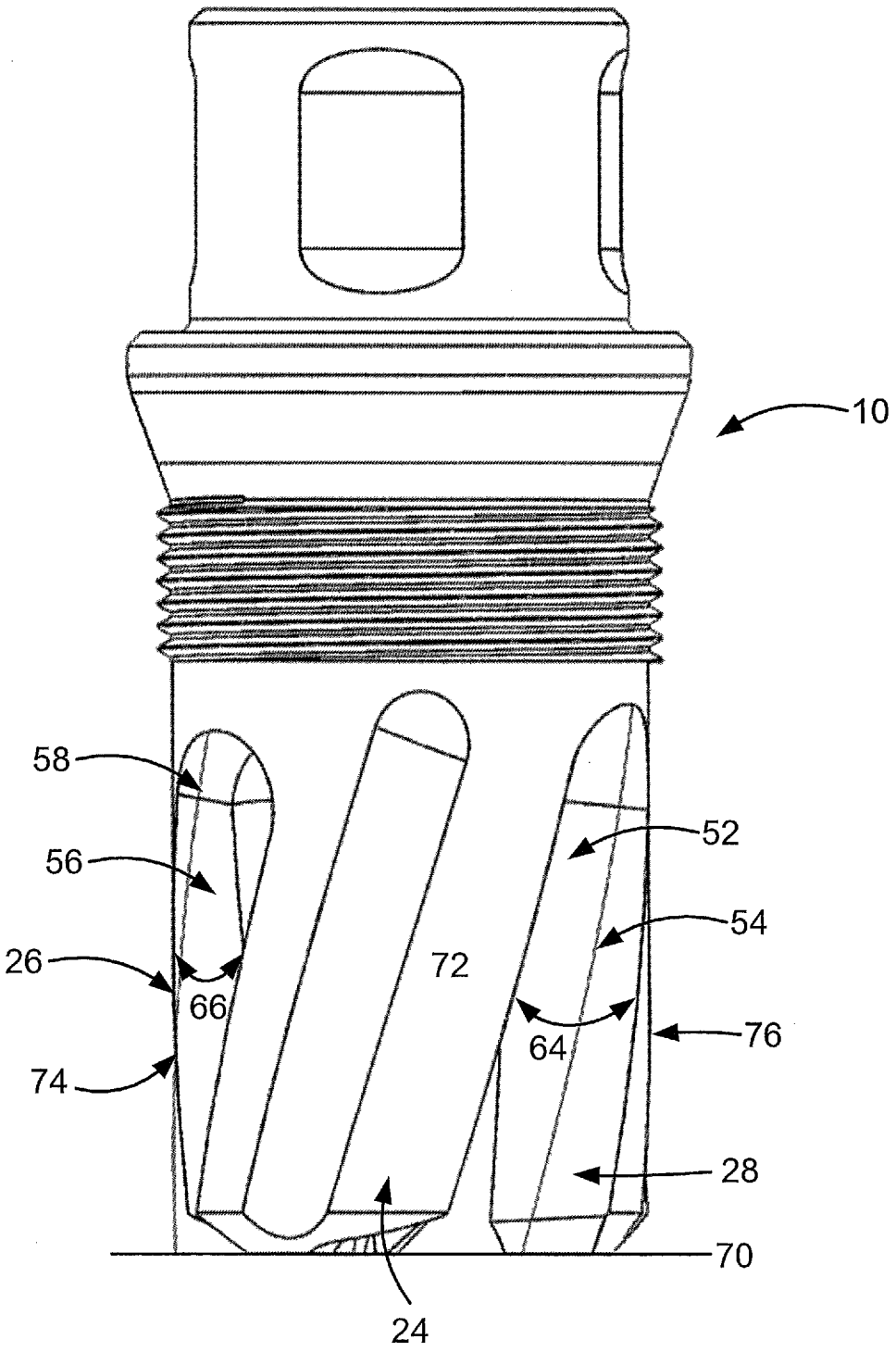
FIG. 6 is a side view of the flash suppressor of FIG. 1.
Figure 7:
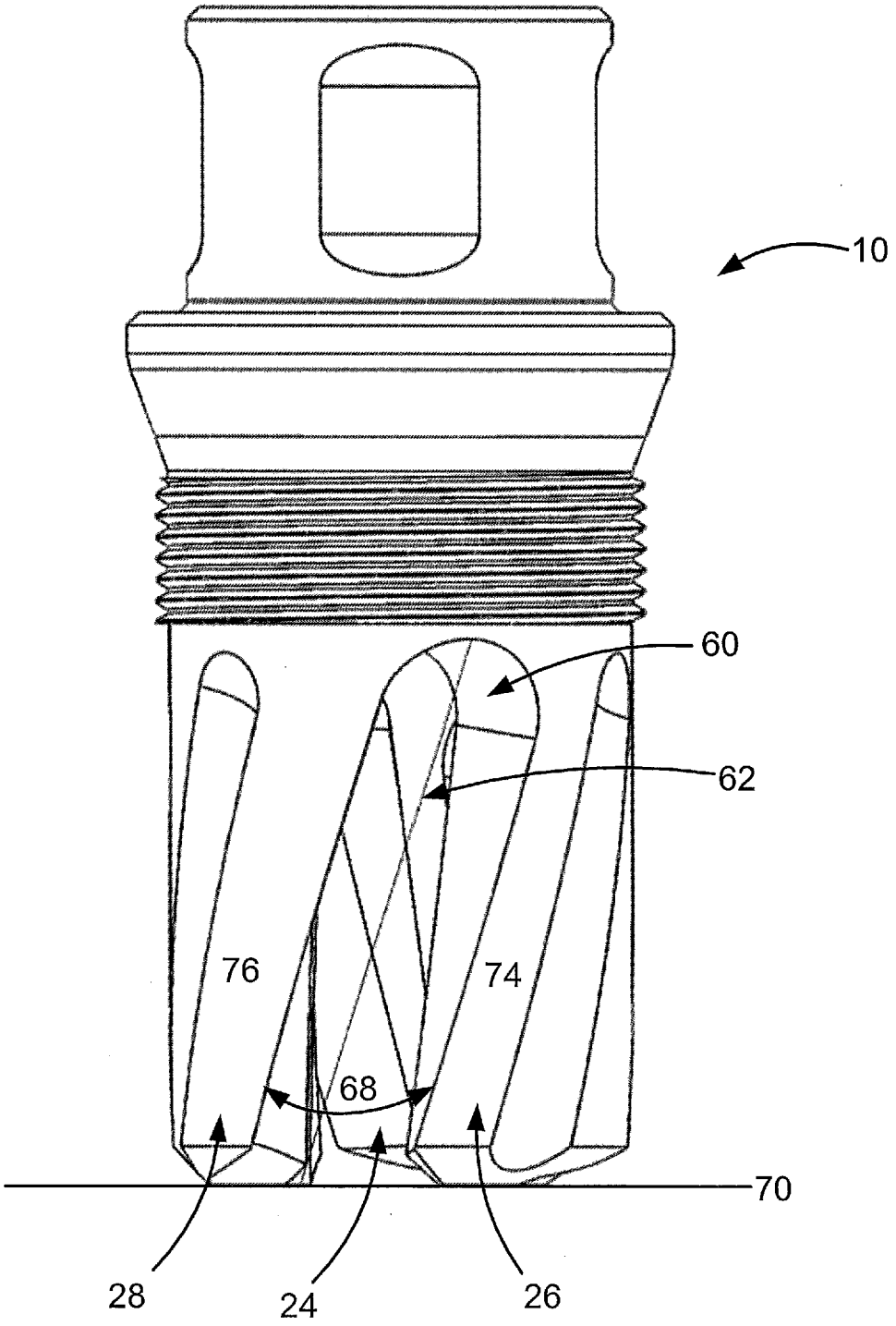
FIG. 7 is a side view of the flash suppressor of FIG. 1 from the opposite side shown in FIG. 6.

In addition to significantly reducing, if not completely eliminating muzzle flash, flash suppressor 10 also eliminates any ringing caused by the resonance of the tines. As shown in FIG. 6, in particular embodiments, cut 52 between tines 24 and 28 has a length 54 that is longer than cut 56 between tines 24 and 26 that has a length 58. Cut 60, which is shown in FIG. 7, has a length 62 between tines 26 and 28 and is located on the back side of flash suppressor 10 in FIG. 6. In addition, the width of the cuts between tines 24, 26, and 28 can also be varied. As shown in FIG. 6, width 64 is between tines 24 and 28 and width 66 is between tines 24 and 26. Width 68 between tines 26 and 28 is shown in FIG. 7 and is located on the back side of flash suppressor 10 in FIG. 6. By varying the length and width of the individual cuts, the potential frequency of the individual tines can be varied to eliminate any audible ringing. In a particular embodiment of flash suppressor 10, which is designed to be used with a 0.223 caliber firearm, the length and width of cuts 52, 56, and 60 that form tines 24, 26, and 28 are as follows:

| | | | |
|---|---|---|---|
| Length 54 | 1.10 inches | Width 64 | 0.3100 inches |
| Length 58 | 1.05 inches | Width 66 | 0.3214 inches |
| Length 62 | 1.00 inches | Width 68 | 0.3275 inches |

With these particular dimensions, tines 24, 26, and 28 did not create any audible ringing when used with a firearm. While not shown in this particular embodiment, the frequency of tines 24, 26, and 28 can alternatively be varied to prevent an audible ringing by altering the dimensions of each groove 36, 38, and 39 in tines 24, 26, and 28, respectively, as shown in FIG. 4. In this particular embodiment, the cuts 52, 56, and 60 that form tines 24, 26, and 28 each rotate at least 30 degrees around the central axis 12 (as shown in FIGS. 1 and 2) from the start of each cut to the finish of each cut.

In addition, as shown in FIGS. 6 and 7, in certain embodiments, tines 24, 26, and 28 all extend to plane 70, which is perpendicular to the distal end of the flash suppressor. When viewed from the distal end, surfaces 78, 80 and 82 shown in FIG. 5 all contact plane 70. In addition, as shown is FIG. 6, outer surfaces 72, 74, and 76 of the tines 24, 26, and 28, respectively, are non-tapered. In other words, the outer surface of each tine remains an equal distance from the center of flash suppressor 10 such that the outer diameter of the suppressor is same throughout the length of tines 24, 26, and 28. Extending tines 24, 26, and 28 to the same plane, and keeping the outer diameter of the suppressor the same throughout the length of the tines, helps ensure that flash suppressor 10 is significantly easier to attach to other firearm components such as a noise suppressor. In addition, tines 24, 26, and 28 are much less susceptible to being entangled in debris and other impediments during field use and uniformly absorb the impact if, for example, the firearm, to which flash suppressor 10 is connected, is dropped on its barrel. By varying the length and widths of the cuts 52, 56, and 60, the mass of each of the tines is the same, which ensures that the flash suppressor is balanced for better performance.

While various embodiments of apparatus are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A suppressor for a firearm, the suppressor comprising:
- a proximal end;
- a distal end; and
- a plurality of tines wherein each tine is formed by a plurality of cuts in the distal end of the suppressor, each cut compromises a length and a width that differ from each adjacent cut, and each tine has the same mass as each other tine.

2. The suppressor of claim 1, wherein the length and width of each cut vary such that each tine has the same mass as each other tine.

3. The suppressor of claim 2, wherein each tine extends to a plane perpendicular to the distal end of the suppressor.

4. The suppressor of claim 3, wherein the length of each cut is at least one inch and the width of each cut is at least 0.3 inch.

5. The suppressor of claim 3, wherein the length of each cut varies by at least three percent from the length of each other cut, and wherein the width of each cut varies by at least one and one half percent from the width of each other cut.

6. The suppressor of claim 1, wherein each tine further comprises a non-tapered outer surface and a groove formed in the non-tapered outer surface wherein the groove of each tine is formed such that each tine has the same mass as each other tine.

7. The suppressor of claim 1, wherein the suppressor further comprises:
- a central axis through the center of the suppressor from the proximal end to the distal end;
- a first interface at the proximal end of the suppressor adapted to be coupled to a muzzle of a firearm;
- a face adjacent to the first interface;
- a first bore with a diameter in the face;
- wherein each tine is a helical tine and each helical tine further comprises:
  - an inner surface wherein the inner surfaces of the plurality of helical tines form a second bore with a diameter substantially the same as the diameter of the first bore; and
  - a non-tapered outer surface.

8. The suppressor of claim 7, wherein each helical tine rotates at least 30 degrees around the central axis.

9. The suppressor of claim 7, wherein each helical tine further comprises a groove formed in the non-tapered outer surface wherein the groove of each tine is formed such that each helical tine has the same mass as each other helical tine.

* * * * *